US005790985A

United States Patent [19]

Hochmuth

[11] Patent Number: 5,790,985

[45] Date of Patent: Aug. 11, 1998

[54] GOALKEEPER'S GLOVE WITH A REDUCED NUMBER OF LONGITUDINAL STITCH SEAMS

[76] Inventor: Peter Hochmuth, Weissenburger Str. 19, D-91757 Treuchtlingen, Germany

[21] Appl. No.: 788,157

[22] Filed: Jan. 24, 1997

[30] Foreign Application Priority Data

Jan. 28, 1996 [DE] Germany ..... 296 01 302 U

[51] Int. Cl.[6] ..... A41D 19/00

[52] U.S. Cl. ..... 2/161.1; 2/159

[58] Field of Search ..... 2/159, 161.1, 161.6, 2/161.7, 164, 167, 168, 169, 162, 163

[56] References Cited

U.S. PATENT DOCUMENTS 5,136,725 8/1992 Montero ..... 2/161.1

FOREIGN PATENT DOCUMENTS 3135756 4/1983 Germany ..... 2/161.1

2281020 2/1995 United Kingdom ..... 2/161.1

*Primary Examiner*—Gloria Hale

*Attorney, Agent, or Firm*—Anderson Kill & Olick, P.C.

[57] ABSTRACT

A goalkeeper's glove including: upper and inner parts having, respectively, upper and inner thumb regions, upper and inner hand regions, and four upper and inner finger regions for fore-, middle, ring and little fingers, with respective upper finger regions being connected with associated inner finger regions along respective longitudinal edges thereof, with a connection between respective upper and inner finger regions for the ring and middle fingers being effected with an intermediate piece and a layer strip, with the respective inner finger regions being flat, and with the inner finger regions for the forefinger and the little finger having a width exceeding those of the associated upper finger regions, being directly attached to the associated upper fingers regions, and having a dome-like shape along their respective widths

6 Claims, 2 Drawing Sheets

GOALKEEPER'S GLOVE WITH A REDUCED NUMBER OF LONGITUDINAL STITCH SEAMS

BACKGROUND OF THE INVENTION

1. Field of the Invention

The present invention relates to a goalkeeper's glove including an upper part having an upper thumb region, an upper hand region, and four upper finger regions for fore-, middle, ring, and little fingers, and an inner part having an inner thumb region, an inner hand region, and four inner finger regions for fore-, middle, ring and little fingers, with respective upper finger regions being connected with associated inner finger regions along respective longitudinal edges thereof, with the inner fingers region for the forefinger and the little finger and the inner hand region being formed as a one-piece part, with a connection between respective upper and inner finger regions for the ring and middle fingers being effected with an intermediate piece and a layer-strip, and with respective inner finger regions for the ring and middle being flat, and with the hand region having a side access for the thumb inner finger region.

2. Description of the Prior Art

A goalkeeper's glove of this type is disclosed in German Patent Publication No. 4,241,261. The German patent discloses a goalkeeper's glove in which the inner finger region for the fore-, and little fingers are connected with respective upper finger regions with a layer strip and an intermediate piece. The width of these inner finger regions, at the hand region, extends only up to the attached inner finger region of the middle and ring fingers, respectively. At that, the inner finger regions for middle and ring fingers are formed integrally as one piece with the hand region. The inner finger regions for the forefinger and the little finger are flat and have, on the outer boundary edge, a seam with a dome-shaped butt. Also, the adjacent dome-shaped butts for fore-, middle, ring, and little fingers are arranged relatively closed to each other on inner side. The advantage of flat inner finger regions consists in that they increase the surface of contact of the glove with a ball. However, there are four seams per finger along longitudinal edges thereof, and there are two inner side stitch seams per finger.

Accordingly, an object of the present invention is a goalkeeper's glove of the above-described type in which the number of stitch seams along the longitudinal edges of the finger regions is reduced.

SUMMARY OF THE INVENTION

This and other objects of the present invention, which will become apparent hereinafter, are achieved by providing a goalkeeper's glove of the above-described type in which the inner finger region for the forefinger has a width exceeding that of the associated upper finger region at the access for the thumb inner finger region, is enlarged in an area of the finger region for the middle finger, is directly attached to the associated upper finger region along longitudinal edges, and has a dome-like shape along the width thereof, in which the inner finger region for the little finger has a width exceeding that of the associated upper finger region at the finger region for the ring finger, is directly attached to the associated upper finger region, and has a dome-like shape along the width thereof, and in which the inner finger regions for the ring and middle fingers are stitched along respective widths thereof to the inner hand region. In the goalkeeper's glove according to the present invention, the flat inner finger regions for the middle and ring fingers provide an adequate contact surface engaging a ball. On the other hand, the forefinger has a freedom of movement and does not have a seam butt along its outer bordering edge on its inner side. When two parts extend on the same side of the stitch seam, a dome-shaped seam butt is provided for the two parts which are stitched with each other When two parts extend on opposite sides of the stitch seam, a flat one-sided stitch seam is provided for the two stitched parts. In the goalkeeper's glove according to the present invention, only two inner finger regions are stitched to the hand region, with the width of each of these two inner finger regions a re equal to the length of the stitching seam. The number of available inner seams on the butts along the longitudinal edges is thereby substantially reduced.

It is especially advantageous when the entire inner region is provided with an outer latex layer and when the latex layer on the inner finger region for the forefinger extends up to the associated longitudinal edge of the upper finger region for the forefinger. The latex layer on the outer bordering edge improves the contact of the glove with the ball in the forefinger finger region, without reducing the contact surface of the inner side of the glove. The latex layer is visible on the edge of the hand region up to the access for the thumb region.

It is further especially advantageous when the seam between the inner finger region for the middle finger or the ring finger and the inner hand region is formed on a butt formed in the glove hollow. In this case, the surface of the inner region is free from any steps as it is provided only with a one-sided seam.

In the goalkeeper's glove according to the present invention, the finger region for the middle finger for the middle finger on a side thereof adjacent to the finger region of the forefinger is provided with a layer strip having a width corresponding to a width of the hand region, and the inner finger region for the forefinger has a dome-like shape and is stitched with the layer strip of the finger region for the middle finger over the strip width. In the inventive goalkeeper's glove, the finger region for the ring finger on a side thereof adjacent to the finger region of the little finger has a layer strip having a width corresponding to a width of the hand region, and the inner finger region for the little finger has a dome-like shape and is stitched with the layer strip of the ring finger over the width of the ring finger layer strip. This simplifies the glove manufacturing and provides for a reliable attachment of the layer strips. It is further especially advantageous when the inner portion has an outer latex layer, and the upper finger region for the forefinger has along both longitudinal edges thereof respective stitch seams forming respective butts defining free bordering, with the free borderings for the forefinger being formed along a width thereof essentially by respective latex layers. On the upper side of the finger regions for the middle and ring finger, the seam butt bordering are substantially free of latex.

BRIEF DESCRIPTION OF THE DRAWINGS

The objects and advantages of the present invention will become more apparent and the invention itself will be best understood from the following detailed description of the Preferred Embodiment, when read with reference to the accompanying drawings, wherein.

DETAILED DESCRIPTION OF THE PREFERRED EMBODIMENT

Figure 1:
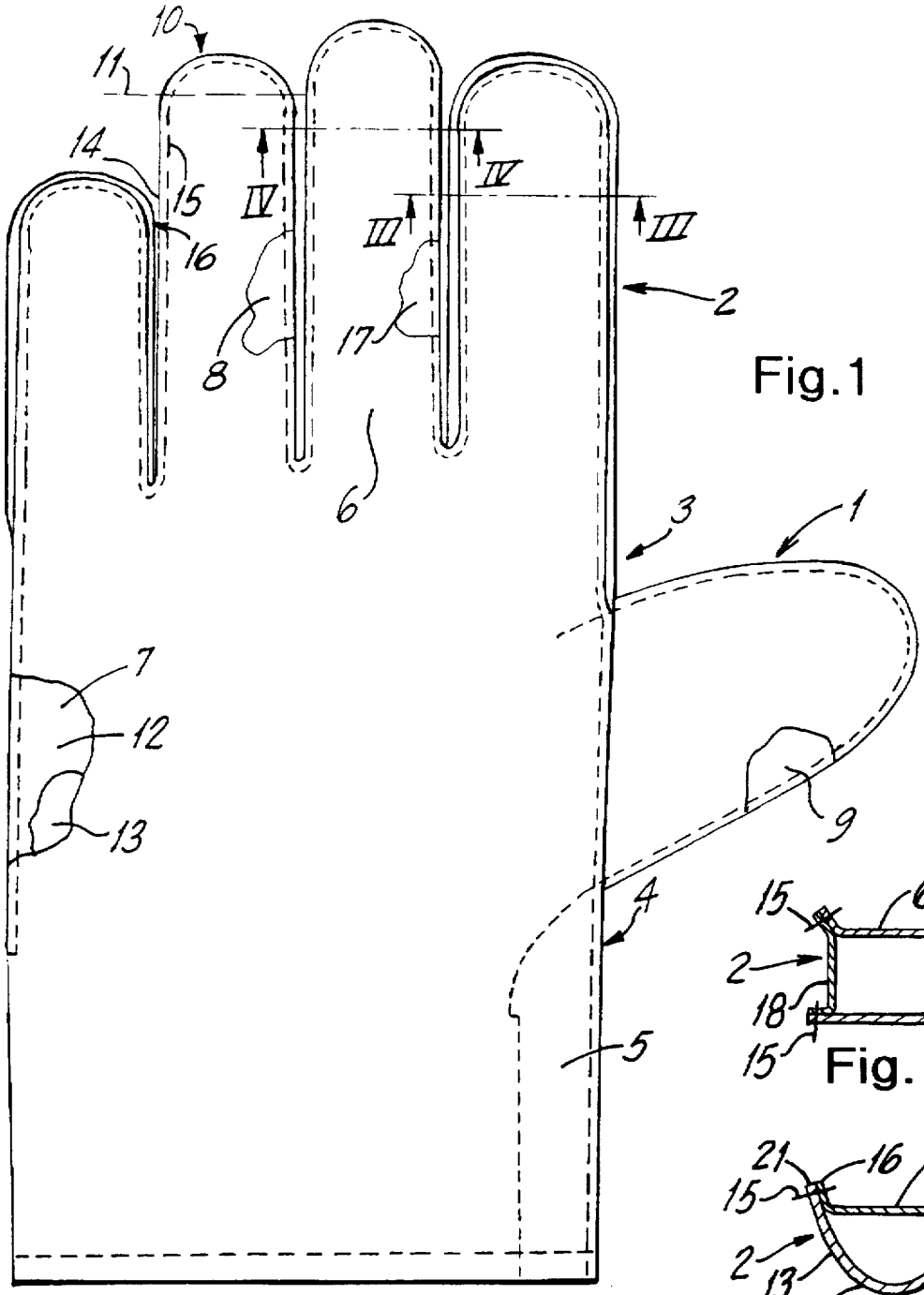
FIG. 1 shows a plan view of a goalkeeper's glove with stitched finger regions according to the present invention.
Figure 4:
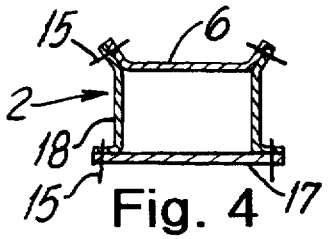
FIG. 4 shows a cross-sectional view along line IV—IV in FIG. 1.
Figure 3:
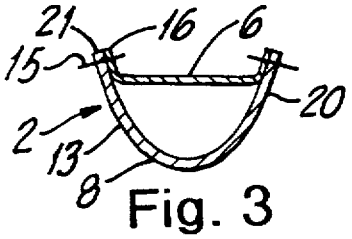
FIG. 3 shows a cross-sectional view along line III—III in FIG. 1.
Figure 2:
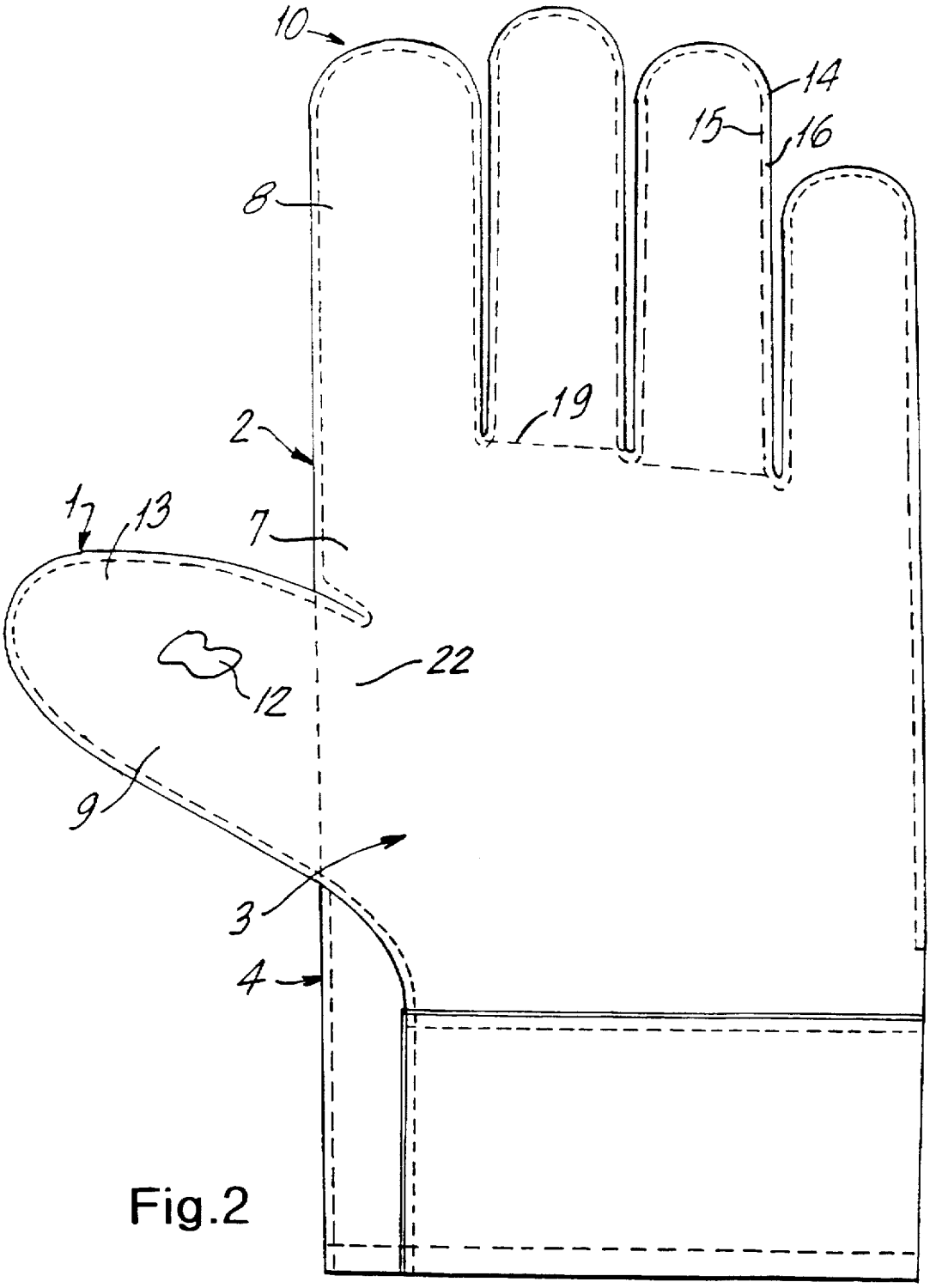
FIG. 2 shows a plan view of an inner side of the goalkeeper's glove shown in FIG. 1.

A goalkeeper's glove according to the present invention which is shown in the drawings, has a thumb region 1, four front finger regions 2, a hand region 3, and a wrist region 4. An upper wrist region, an upper hand region and four upper finger regions 6 form together a one-piece upper part 5 of the glove. The inner hand region, four front inner finger regions 8 for fore-, middle, ring, and little fingers, and an inner finger region 9 of the thumb region 1 form together a onepiece inner part 7 of the glove. The upper part 5 is superimposed on the inner part 7. The tips of the front finger regions 2 and of the thumb region 1 define fingertip caps 10 the ends of which adjacent to the hand region 3 are marked with a dash line 11. The inner portion 7 is formed of a carrier layer 12 with a superimposed outer latex layer 13. The four front finger regions 2 and the thumb region 1 are stitched along their respective lateral edges 14 with seams 15 so that ridge-like butts are formed.

At front finger regions 2 for the middle and ring fingers, layer strips 18 are provided between an upper region 6, on one hand, and an inner finger region 8 for the ring finger and an inner finger region 17 for the middle finger, on the other hand. The respective strips 18 are stitched to respective finger regions along their longitudinal edges with stitches 15. The inner finger region 17 for the middle finger and the inner finger region 8 for the ring finger are stitched to the hand region 3 with transverse seams 19. For the forefinger, the inner finger region 8 has, along its both longitudinal edges, respective widenings 20 which extend up the to upper finger region 6. There, for the seam 15, there is provided a butt 16 which, at the free bordering 21 of the widened inner finger region 8, is formed essentially of a latex layer. The inner finger region 9 of the thumb region 1 passes, along a linear region 22, into the hand region. For the little finger, the inner finger region has, along its longitudinal edge adjacent to the ring finger, a widening extending up to the upper finger region, whereas along the outer longitudinal edge, the inner finger region is stitched or sewn to the upper finger region without a widening.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A goalkeeper's glove, comprising:

an upper part having an upper thumb region, an upper hand region, and four upper finger regions for fore-, middle, ring and little fingers; and an inner part having an inner thumb region, an inner hand region, and four inner finger regions for fore-, middle, ring and little fingers, wherein respective upper finger regions are connected with associated inner finger regions along respective longitudinal edges thereof, wherein the inner finger regions for the forefinger and the little finger and the inner hand region are formed as a one-piece part, wherein for the ring and middle fingers, a connection between respective upper and inner finger regions is effected with an intermediate piece and a layer strip, and the respective inner finger regions are flat, wherein the hand region has a side access for the thumb inner finger region, wherein the inner finger region for the forefinger has a width exceeding a width of the associated upper finger region at the access for the thumb inner finger region, is enlarged in an area of the finger region for the middle finger, is directly attached to the associated upper finger region along longitudinal edges, and has a dome-like shape along the width thereof, wherein the inner finger region for the little finger has a width exceeding that of the associated upper finger region at the finger region for the ring finger, is directly attached to the associated upper finger region, and has a dome-like shape along the width thereof, and wherein the inner finger regions for the ring and middle fingers are stitched along respective width thereof to the inner hand region.

2. A goalkeeper's glove asset forth in claim 1, wherein the inner hand region of the glove has a latex layer, and wherein the inner finger region for the forefinger has an outer latex layer extending up to an associated longitudinal edge of the forefinger.

3. A goalkeeper's glove as set forth in claim 1, wherein a stitch seam between the inner finger region for the middle finger and the inner hand region is provided on a butt arranged in a glove hollow.

4. A goalkeeper's glove as set forth in claim 1, wherein the finger region for the middle finger on a side thereof adjacent to the finger region of the forefinger is provided with a layer strip having a width corresponding to a width of the hand region, and wherein the inner finger region for the forefinger has a dome-like shape and is stitched with the layer strip of the finger region for the middle finger over the strip width.

5. A goalkeeper's glove as set forth in claim 1, wherein the finger region for the ring finger on a side thereof adjacent to the finger region for the little finger has a layer strip having a width corresponding to a width of the hand region, and wherein the inner finger region for the little finger has a dome-like shape and is stitched with the layer strip of the ring finger over the width of the ring finger layer strip.

6. A goalkeeper's glove as set forth in claim 1, wherein the inner portion has an outer latex layer, wherein the upper finger region for the forefinger has along both longitudinal edges thereof respective stitch seams forming respective butts defining free bordering, and wherein the free borderings for the forefinger are formed along a width thereof essentially by respective latex layers.

* * * * *

UNITED STATES PATENT AND TRADEMARK OFFICE

CERTIFICATE OF CORRECTION

PATENT NO. : 5,790,985

DATED : Aug. 11, 1998

INVENTOR(S) : Peter Hochmuth

It is certified that error appears in the above-identified patent and that said Letters Patent is hereby corrected as shown below:

On title page, item [30] should read as follows:

[30] Foreign Application Priority Data:

Jan. 26, 1996 [DE] Germany .....296 01 302 U

Signed and Sealed this

Twenty-seventh Day of July, 1999

*Attest:*

Q. TODD DICKINSON

*Attesting Officer*

*Acting Commissioner of Patents and Trademarks*